United States Patent [19]

Revil et al.

[11] Patent Number: 4,979,910

[45] Date of Patent: Dec. 25, 1990

[54] ELECTRICAL CONNECTOR HOUSING ASSEMBLY

[75] Inventors: Jean-Jacques Revil, Pantin; Jean Ittah, Villeneuve la Garenne, both of France

[73] Assignee: Labinal S.A., Montigny le Bretonneux, France

[21] Appl. No.: 406,364

[22] Filed: Sep. 12, 1989

[30] Foreign Application Priority Data

Sep. 20, 1988 [FR] France ..... 88 12265

[51] Int. Cl.[5] ..... H01R 13/627

[52] U.S. Cl. ..... 439/357; 439/358; 439/680

[58] Field of Search ..... 439/345, 350, 352, 353, 439/354, 355, 357, 358, 367, 680, 296, 310

[56] References Cited

U.S. PATENT DOCUMENTS

| | | | |
|---|---|---|---|
| 4,392,706 | 7/1983 | Baker et al. | 439/353 |
| 4,397,511 | 8/1983 | Clark et al. | 439/350 X |
| 4,655,527 | 4/1987 | Vandame | 439/350 |
| 4,695,112 | 9/1987 | Maston et al. | 439/680 |
| 4,867,699 | 9/1989 | Oda et al. | 439/350 X |

FOREIGN PATENT DOCUMENTS

| | | |
|---|---|---|
| 0005594 | 11/1979 | European Pat. Off. . |
| 0030768 | 6/1981 | European Pat. Off. . |
| 2909616 | 9/1980 | Fed. Rep. of Germany . |

OTHER PUBLICATIONS

Abstracted version of German patent 8600466.

*Primary Examiner*—Eugene F. Desmond
*Attorney, Agent, or Firm*—Sandler, Greenblum & Bernstein

[57] ABSTRACT

An electrical connector housing comprises a male housing member, a corresponding female housing member and a skirt on the female housing member adapted to receive an anterior end of the male housing member. Channels in the male and female housing members are adapted to receive respective electrical contact members. Means for locking the male and female housing members together when the anterior end of the male housing member is inserted into the skirt comprise a resilient bar having two feet joined to the male housing member near its anterior end, an operating member at its free end and first locking members. The skirt comprises second locking members adapted to cooperate with the first locking members and a protuberance on its inside surface. The resilient bar further comprises a projection adapted to cooperate with this protuberance and having a first ramp inclined so that insertion of the male housing member into the skirt requires an additional force to allow the first ramp to pass by virtue of resilient deformation of the bar, a second ramp and an edge between the first and second ramps. When the protuberance has passed over the edge during insertion of the male housing member into the skirt, the second ramp tends to facilitate further insertion.

36 Claims, 6 Drawing Sheets

XV
XVII
XI
XIII
46
49
58
42
41
44
50
56
48
58a
58b
58c
58d

ELECTRICAL CONNECTOR HOUSING ASSEMBLY

BACKGROUND OF THE INVENTION

1. Field of the Invention

The present invention is aimed at improving electrical connector housings.

2. Discussion of Background Information

The invention is directed to housings comprising a male member and a corresponding female member, with these members containing complementary electrical connection members.

One disadvantage of this kind of housing is that the male member is very often insufficiently inserted with the result that the electrical connections are imperfect.

One object of the present invention is to remedy this disadvantage.

SUMMARY OF THE INVENTION

It is an object of the present invention to provide an electrical connector assembly having the ability to push back the male housing member if it is insufficiently pushed into the skirt of the female housing member, and the ability to facilitate completion of the insertion of the male housing member into the female housing member if the male housing member is sufficiently inserted into the skirt.

The object of the present invention may be achieved by providing an electrical connector housing which includes a male housing member and a corresponding female housing member. The female housing member is provided with a skirt that is adapted to receive an anterior end of the male housing member. Channels are provided in the male housing member and the female housing member which are adapted to receive respective electrical contact members. Moreover, means are provided for locking the male and female housing members together when the anterior end of the male housing member is inserted into the skirt. The means for locking may be composed of a resilient bar having a fixed end and a free end, with the fixed end having two feet joined to the male housing member near the anterior end. An operating member may be provided at the free end of the resilient bar, and the resilient bar may also include first locking members. Additionally, the skirt may include second locking members adapted to cooperate with the first locking members and a protuberance on its inside surface. The resilient bar also includes a projection adapted to cooperate with the protuberance, as well as a first ramp inclined so that insertion of the male housing member into the skirt requires an additional force to allow the first ramp to pass by virtue of resilient deformation of the resilient bar. A second ramp and an edge between the first and second ramps are also provided, so that when the protuberance has passed over the edge during insertion of the male housing member into the skirt, the second ramp tends to facilitate further insertion of the male housing member into the skirt.

The protuberance may comprise two lugs on the inside wall of the skirt, with profiled flanges on the lugs. The resilient bar may comprise two projections on respective opposite sides of the resilient bar that are each adapted to cooperate with a corresponding flange. Furthermore, each first ramp may be provided with a respective resilient tang which is forward of the first ramp and extends from the first ramp. Furthermore, notches may be present at the rear of the projections adapted to accommodate the profiled flanges, with the height of the resilient tangs being such that upon inserting the male housing member into the skirt, the flanges abut against them.

Each profiled flange may be provided with a flat front at the end towards the open end of the skirt, a flat heel at the other end, and an upper edge that is inclined adjacent the flat front.

The resilient bar may include a tab to limit its movement in the direction of insertion of the male housing member into the skirt. Additionally, the resilient bar may be divided into two branches, and may further comprise, between the two branches, two resilient tangs of which one end is joined to the operating member while the free end is provided with said projection. The projection on one of the resilient tangs may face towards the projection on the other tang, with each projection comprising a first ramp, an edge and a second ramp, so that the ramps face each other and the first ramps form a convergent entry, while the protuberance is formed by a lug extended towards the rear by a wedge-shaped part ending in a flat front.

The free end of the protuberance may be joined to a profiled flange which has at its anterior end an edge inclined from its upper surface towards its lower surface and at its posterior end an edge inclined from its lower surface towards it upper surface. Furthermore, the projections may be provided with a lower surface that becomes progressively narrower in the direction towards the free end and an upper surface which gets progressively narrower from the edge towards said operating member. The position of the projections and of the flange may be such that upon insertion of the male housing member into the skirt, the inclined edge of the anterior end of the flange abuts against the thinner end of the lower surface of the projections.

The skirt may be provided with housings and the upper edges of the branches of the resilient bar may be provided with lugs adapted to be inserted into the housings.

In another manner of viewing the present invention, an electrical connector housing assembly is provided which includes a male housing member and a corresponding female housing member. The male housing member is provided with a series of passages that are capable of receiving electrical contact members. The female housing member is provided with a skirt portion adapted to receive an anterior end of the male housing member, and is further provided with a series of passages corresponding to those in the male housing member which are capable of receiving corresponding electrical contact members. The electrical connector housing assembly also includes means for locking the male housing member and female housing member together when the anterior end of the male housing member is inserted into the skirt portion of the female housing member. The means for locking include means for pushing apart the male housing member and the female housing member until a sufficient force is exerted, means for facilitating further insertion of the male housing member into the female housing member upon exertion of the sufficient force, and means forming a threshold element which forms a transition zone between the means for pushing apart and the means for facilitating insertion upon exertion of the sufficient force.

The means for pushing apart, the means for facilitating further insertion, and the means forming a threshold element may be positioned on a resilient bar, and the resilient bar may be provided with a fixed end that is joined to the male housing member near the anterior end, and a free end.

The means for locking may include protuberance means positioned on the female housing member.

The means for pushing apart may comprise a first ramp means that is inclined so that insertion of the male housing member into the skirt portion requires an additional force to allow the first ramp means to pass the protuberance means by virtue of resilient deformation of the resilient bar; the means for facilitating further insertion may comprise a second ramp means inclined so that passage of the second ramp means past the protuberance means is facilitated; and the means forming a threshold element may comprise an edge between the first ramp means and the second ramp means.

The protuberance means may comprise two lugs on the inside wall of the skirt portion, and a flange on each of the two lugs. The resilient bar may comprise two sets of the first ramp means, the second ramp means and the edge positioned on respective opposite sides, with each of the two sets being adapted to cooperate with a flange.

A resilient tang may be positioned forward of and extending from each the first ramp means, and notches may be provided to the rear of each of the second ramp means, with each notch being adapted to accommodate a corresponding flange, with the height of each of the resilient tangs being such that, upon inserting the male housing member into the skirt portion, each flange abuts against the corresponding resilient tang.

The flange may include a flat front end, and an upper edge that is downwardly inclined to a rearward, flat heel.

The resilient bar may include a tab to limit downward movement when the male housing member is being inserted into the female housing member. Furthermore, the resilient bar may be movable in an upward direction to permit each of the rearward, flat heels to be positioned below each notch, whereby the male housing member and the female housing member may be pulled apart with the flanqe means sliding below each resilient tang.

Still further, the means for locking may include protuberance means and means forming apertures located on the female housing member, and projections mounted on the resilient bar that fit into the means forming apertures when the male housing member and the female housing member are assembled. In such an embodiment, the resilient bar may be divided into two branches, and may further comprise between the two branches two resilient tangs. Additionally, the means for pushing apart may comprise a first ramp means that has an inclined edge so that insertion of the male housing member into the skirt portion requires an additional force to allow the first ramp means to pass the protuberance means by virtue of resilient deformation of the resilient tangs; the means for facilitating further insertion may comprise a second ramp means having an inclined edge portion so that passage of the second ramp means past the protuberance means is facilitated; and the means forming a threshold element may comprise an edge between the first ramp means and the second ramp means.

Each of the two resilient tangs may have a rearward end that is attached to the resilient bar, and a forward, free end; and the resilient bar may include two sets of the first ramp means, the second ramp means and the edge, with the two sets being positioned substantially adjacent to the forward, free end of each of the resilient tangs. The first ramp means and the second ramp means in each of the two sets may be positioned on the two resilient tangs to face each other, with each edge of the two sets being positioned adjacent each other thereby forming a convergent entry.

The protuberance means may comprise a lug having a wedge-shaped part which extends rearwardly into the female housing member, and ends in a flat front.

For each resilient tang, the first ramp means may include a lower surface that becomes progressively thicker in a direction towards the edge, and the second ramp means may include a lower surface that becomes progressively thinner in a direction away from the edge and towards the fixed end of the resilient tang.

The lug may include an anterior end having an edge that is rearwardly and upwardly inclined from a lower surface to an upper surface, whereby when the male housing member is inserted into the female housing member, the inclined, anterior end abuts against the lower surface of the first ramp means.

For each resilient tang, the first ramp means may include an upper surface that becomes progressively thicker in a direction towards the edge, and the second ramp means may include an upper surface that becomes progressively thinner in a direction away from the edge and towards the fixed end of the resilient tang; and the lug may include a posterior end having an edge that is rearwardly and upwardly inclined from a lower surface to an upper surface, whereby when the resilient bar is pushed in a downward direction, the projections are disengaged from the means forming apertures, and the inclined, posterior end contacts the upper surface of the second ramps means so that the male housing member and female housing member may be disassembled.

The present invention is also directed to a male housing member which includes a housing member having a series of passages that are capable of receiving female electrical contact members; and a resilient bar having a fixed end that is joined to the male housing member, and a free end. The resilient bar is provided with first ramp means having a rearwardly and upwardly inclined upper surface, a second ramp means having a rearwardly and downwardly inclined upper surface, with the first ramp means and the second ramp means being connected by an edge.

The resilient bar may be provided with two sets of the first ramp means, the second ramp means and the connecting edge mounted on opposite sides of the resilient bar. Additionally, a resilient tang may be positioned forward of and extending from each the first ramp means, and notches may be provided to the rear of each of the second ramp means.

Still yet, the present invention is directed to a male housing member which includes a housing member which is provided with a series of passages that are capable of receiving electrical contact members, and a resilient bar having a fixed end that is joined to the male housing member, and a free end. The resilient bar is divided into two branches and comprises, between the two branches, two resilient tangs, with each of the two resilient tangs having a rearward end that is attached to the resilient bar, and a forward, free end. Each of the two resilient tangs includes substantially adjacent to the forward, free end, a first ramp means, a second ramp means, and an edge connecting the first ramp means and the second ramp means. Moreover, the resilient bar includes projections on an upper surface.

The first ramp means may be located closer to the free end of the resilient tang than the second ramp means, with the first ramp means and the second ramp means being positioned on the two resilient tangs to face each other, and the edges being positioned adjacent each other.

The first ramp means and the second ramp means may be provided with inclined surface portions, with the first ramp means being upwardly inclined towards the edge, and the second ramp means being downwardly inclined away from the edge.

For each resilient tang, the first ramp means may include a lower surface that becomes progressively thicker in a direction towards the edge, and the second ramp means may include a lower surface that becomes progressively thinner in a direction away from the edge and towards the fixed end of the resilient tang.

Furthermore, for each resilient tang, the first ramp means may include an upper surface that becomes progressively thicker in a direction towards the edge, and the second ramp means may include an upper surface that becomes progressively thinner in a direction away from the edge and towards the fixed end of the resilient tang.

In each of the above embodiments, the resilient bar may include two feet for fixing the fixed end to the male housing member. Furthermore, means for polarizing may be provided.

Still yet, the present invention is directed to a female housing member that includes a housing member that is provided with a skirt portion adapted to receive an anterior end of a male housing member. The housing member is provided with a series of passages adapted to correspond to a series of passages in the male housing member. Two lugs are provided on the inside wall of the skirt portion, and a flange is provided on each of the two lugs. Each flange includes a flat front end, and an upper edge that is downwardly inclined to a rearward, flat heel.

In still another aspect of the invention, a female housing member is provided that includes a housing member having a skirt portion adapted to receive an anterior end of a male housing member, which housing member includes a series of passages adapted to correspond to a series of passages in the male housing member. Additionally, means forming apertures are located on the female housing member, as well as a lug having a wedge-shaped part which extends rearwardly into the female housing member, and ends in a flat front.

The lug may include an anterior end having an edge that is rearwardly and upwardly inclined from a lower surface to an upper surface. Furthermore, the lug may include a posterior end having an edge that is rearwardly and upwardly inclined from a lower surface to an upper surface.

Additionally, the above-described female housing members may include means for polarizing.

As discussed above, in one embodiment, the height of the resilient tangs is such that upon inserting the male housing member into the skirt, the flanges abut against them. By virtue of this feature, the repulsion action in the event of incorrect insertion is increased by the resilient tangs.

Moreover, as discussed above, in another embodiment wherein the resilient bar is divided into two branches, the resilient action of the resilient tangs is strengthened by the resilient action of the branches of the resilient bar.

The invention will now be described with reference to specific embodiments shown in the appended drawings by way of example only.

DESCRIPTION OF THE PREFERRED EMBODIMENTS

Figure 1:
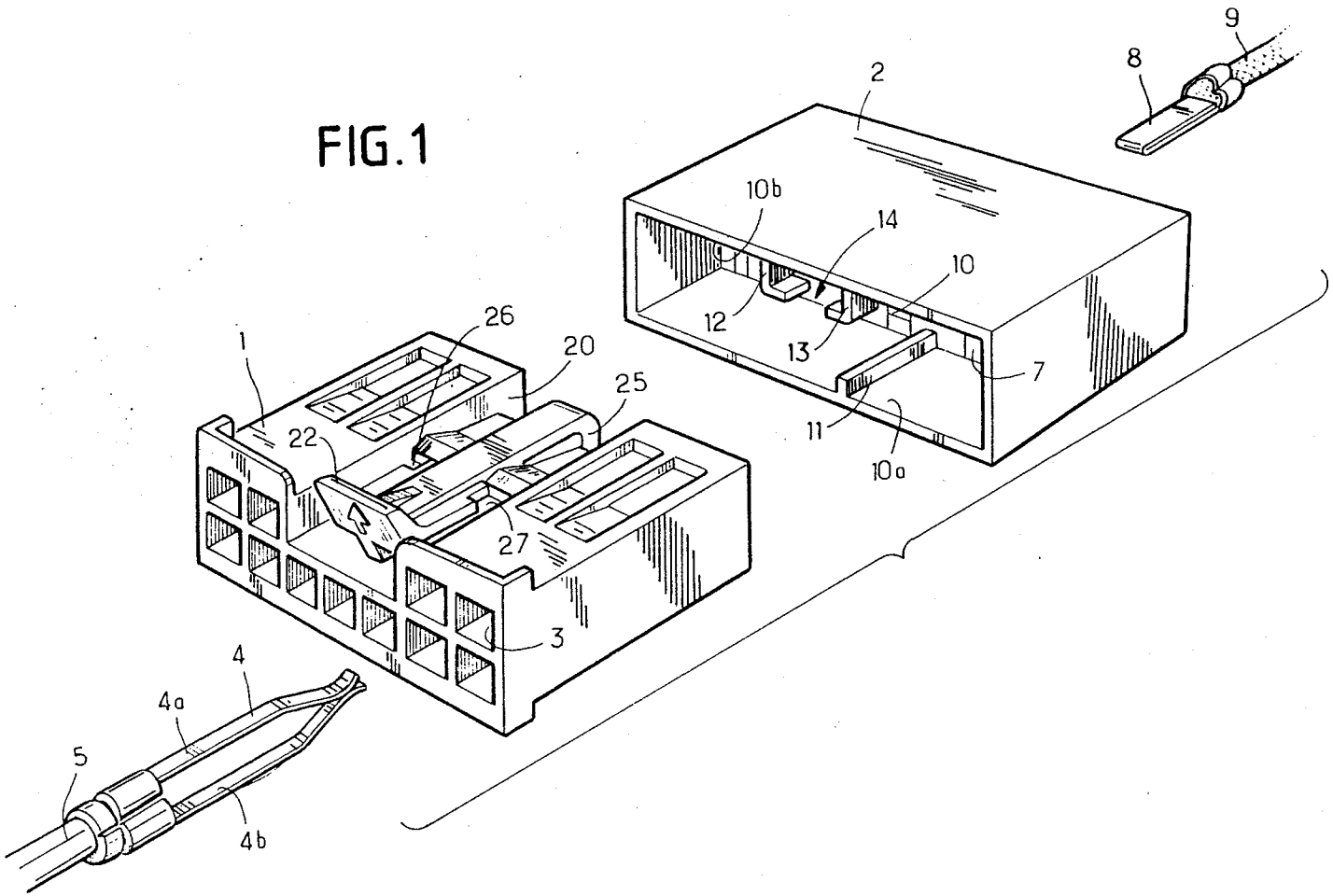
FIG. 1 is a perspective view of a housing in accordance with the invention.
Figure 2:
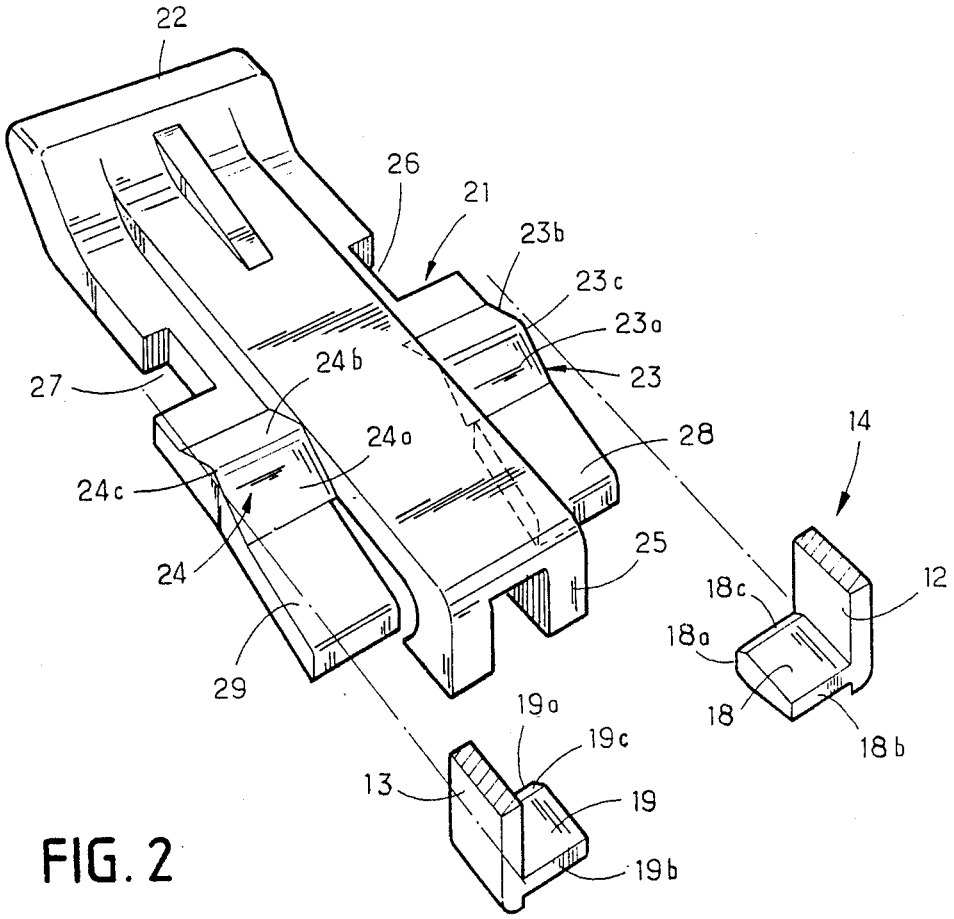
FIG. 2 is a perspective view of one detail to a larger scale.

The housing illustrated in FIGS. 1 through 7 comprises a male housing member 1 and a female housing member 2. The male housing member 1 includes a series of passages 3 each adapted to receive a female electrical contact member 4 attached to the end of an electrical conductor 5.

In this embodiment the female electrical contact member 4 comprises two resilient branches **4*a* and 4*b***, however, other designs are possible.

The female housing member 2 has a generally parallepiped-shaped body with a series of passages 7 each adapted to contain a male electrical contact member 8 attached to a conductor 9 and designed to be inserted into the corresponding female electrical contact member 4.

The female housing member 2 is extended by a skirt 10 into which the male electrical contact members 8 project and which is designed to receive the male housing member 1.

On one internal surface **10*a*, opposite the surface 10*a* the skirt 10 comprises a rib 11 designed to cooperate with a groove (not visible in the drawing) on the member 1** in such a way as to form a polarizing system.

On its internal surface **10*b* opposite the surface 10*a*, the skirt comprises protuberances 14 formed by two lugs 12 and 13 with respective integral flanges 18 and 19**.

The flange 18 is perpendicular to the lug 12 and shaped to feature on the side towards the opening of the skirt 10 a flat front **18*a*** and on the opposite side a flat heel 18*b*. The upper edge 18*c* is inclined adjacent the flat front 18*a*.

The flange 19 is perpendicular to the lug 13 and its free end faces towards the free end of the flange 18, said flange 19 having a flat front 19*a*, inclined part 19*c* and a flat heel 19*b*.

In the central part of the male housing member 1 is a corridor 20 occupied by a locking member 21 in the form of a resilient bar.

One end of the resilient bar is joined to feet 25, which are joined to the bottom of the corridor 20 towards the anterior end of the male housing member 1. The other end of the resilient bar, i.e., the free end of the resilient bar, ends in a tab 22*a* with an operating member 22 for raising or pushing down the locking member 21.

On one lateral edge, the resilient bar comprises a first projection 23 featuring a first inclined ramp 23*a*, an edge 23*c* and a second ramp 23*b* inclined in the opposite direction to the first ramp. On its other lateral edge, the bar comprises a second projection 24 corresponding to the first with two ramps 24*a* and 24*b*, and an edge 24*c*.

To the rear of the projections 23 and 24, the locking member 21 comprises notches 26 and 27, and, adjacent the feet 25 the projections 23 and 24 are extended by respective resilient tangs 28 and 29.

Figure 5:
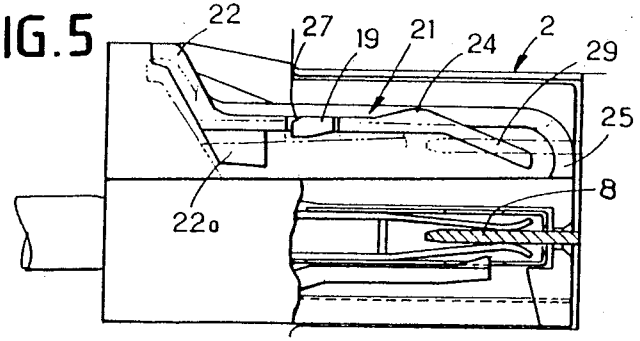
FIG. 3 through 7 are schematic views showing how the housing functions.
Figure 3:
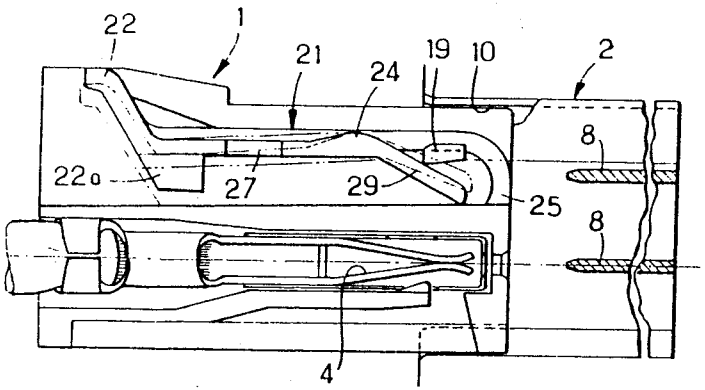
Figure 4:
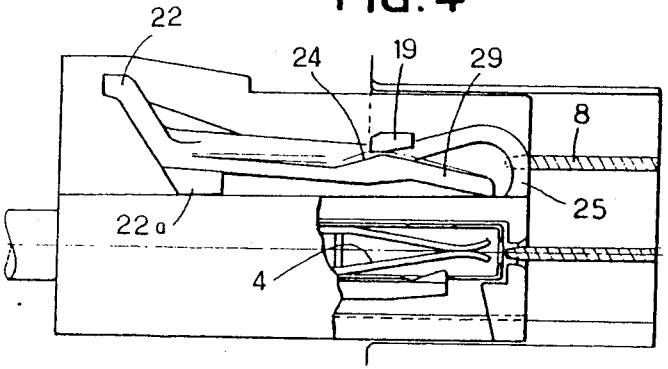
Figure 8:
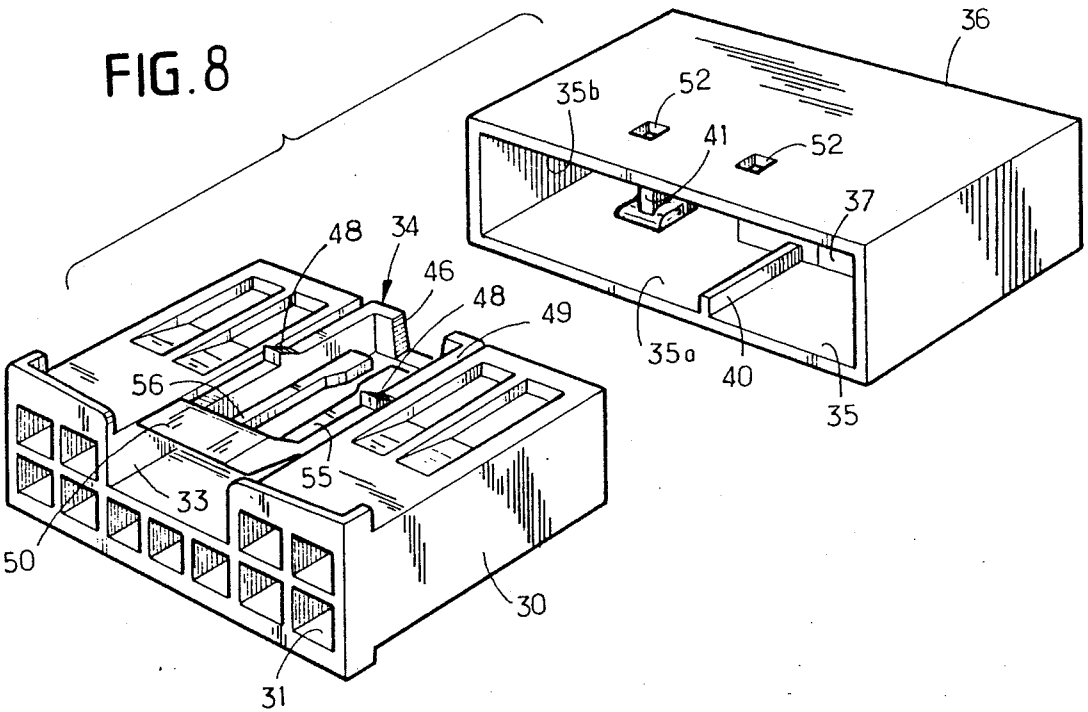
FIG. 8 is a perspective view showing an alternative embodiment of the housing in accordance with the invention.
Figure 9:
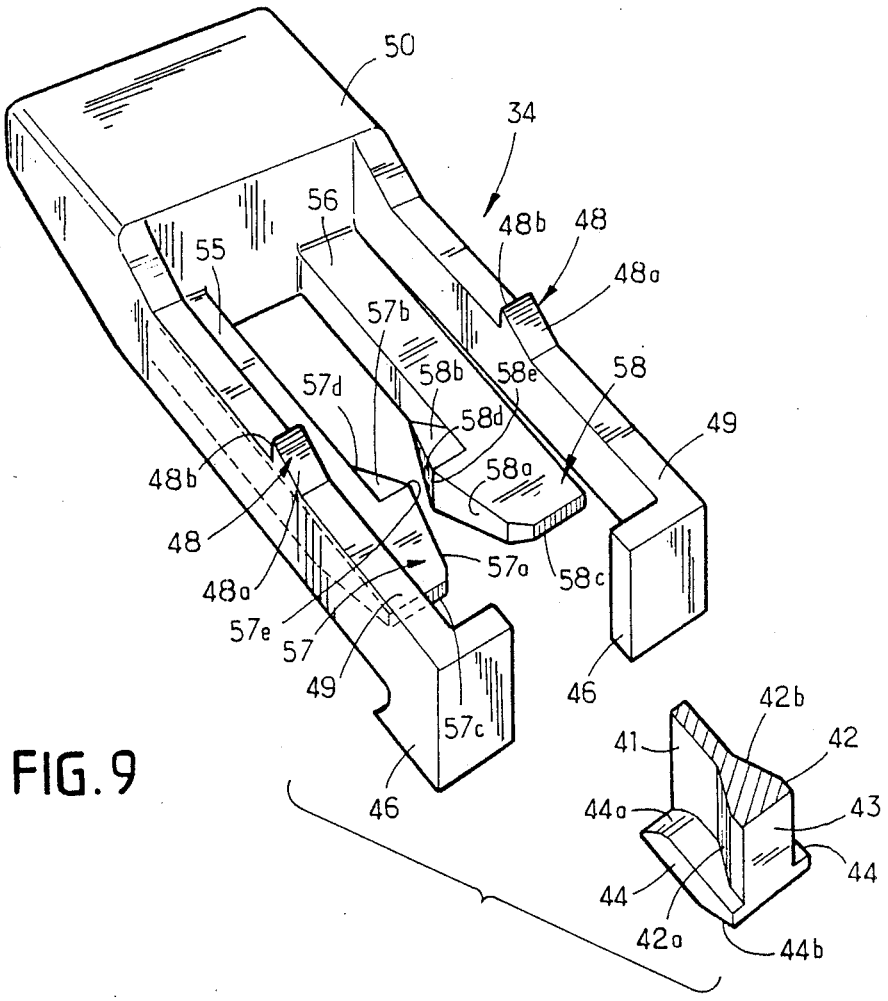
FIG. 9 is a perspective view of one detail to a larger scale.

FIGS. 3, 4 and 5 show various stages in assembling together the two housing members 1 and 2.

The gap between the lugs 12 and 13 corresponds to the gap between the free edges of the tangs and the position of the flanges 18 and 19 is such that when the male housing member 1 is inserted into the skirt 10 they abut against the tangs 28 and 29.

When the male housing member 1 is inserted into the skirt 10, the flanges 18 and 19 cause the locking member 21 to tilt until they pass over the edges 23*c* and 24*c*, and by cooperating with the ramps 23*b* and 24*b* they then facilitate further insertion of the male housing member into the skirt 10, the two members 1 and 2 being locked together when the flanges 18 and 19 are engaged in the corresponding notches 26 and 27.

Thanks to this kind of arrangement, if the male housing member 1 is not sufficiently inserted into the skirt 10 the resilient tangs 28 and 29 tend to move the members 1 and 2 apart. This resilient action is strengthened by the tab 22*a*, which by butting against the bottom of the corridor 20 limits movement of the resilient bar.

If the male housing member 1 is inserted into the skirt 10 until the flanges 18 and 19 pass over the edges 23*c* and 24*c*, the resilient action of the locking member 21 and the ramps 23*b* and 24*b* tends to facilitate further insertion of the member 1 into the member 2 towards the locking position.

Figure 6:
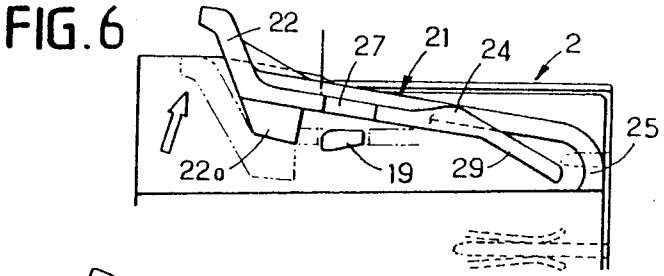
Figure 7:
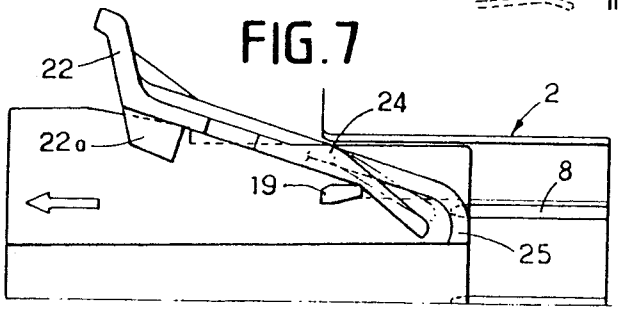

To separate the members 1 and 2, the locking member 21 is raised to release the flanges 18 and 19 from the notches 26 and 27 and one of the housing members 1 or 2 is pulled so that the flanges 18*a* and 19 pass under the ramps 23 and 24 and raise resiliently the tangs 28 and 29 (FIGS. 6 and 7). This requires less force than is required for insertion because the resilient tangs 28 and 29 are independent at their free ends, and because there is no limit to the tilting of the resilient bar in this direction.

FIGS. 8 through 16 show an alternative embodiment of the invention in which a male housing member 30 is provided with a series of passages 31, each adapted to receive a female contact member like the female electrical contact member 4. Furthermore, the male housing member includes a central part comprising a corridor 33 in which is positioned a locking member 34.

The male housing member 30 is adapted to be inserted into the skirt 35 of a female housing member 36. The female housing member is provided with passages 37 corresponding to the passages 31 and receive male electrical contact members, such as the male contact members 8 provided in the first embodiment.

One of the inside walls 35*a* of the skirt comprises a rib 40 designed to cooperate with a groove (not visible in the drawings) in the member 30 to constitute a polarizing device.

The wall 35*a* of the skirt 35 opposite the wall 35*a* comprises a protuberance 41 which is formed by a lug extended towards the rear by a wedge-shaped part 42 comprising two ramps 42*a* and 42*b*, and a flat front 43.

At its lower free end, the protuberance 41 is joined to two flanges 44 which have at their anterior end a downwardly inclined edge 44*a* and at their posterior end an inclined part 44*b*.

The locking member 34, in the form of a resilient bar, comprises two feet 46 which are joined to the anterior end of the corridor 33, extended by branches 49 of the resilient bar and joined to an operating member 50.

Each branch 49 comprises at a point intermediate its length a lug 48 comprising a ramp 48*a* and a flat front 48*b*, these lugs being adapted to cooperate with holes or housings 52 provided on the wall 35*b* of the skirt 35.

Between the branches 49 are two resilient tangs 55 and 56 of which one end is attached to the operating member 50.

At its free end, the tang 55 comprises a projection 57 facing towards the tang 56 and featuring an inclined ramp 57*a* joined to an inclined ramp 57*d* by an edge 57*e*, a thinner side 57*c* at the free end and a side 57*b* inclined towards the rear from the edge 57*e*.

The tang 56 comprises a projection 58 with an inclined ramp 58*a* which forms with the ramp 57*a* a tapered opening, an edge 58*e* corresponding to the edge 57*e* and a ramp 58*d*, the lower surface 58*c* becoming progressively thinner towards the free end and the upper surface 58*b* becoming progressively thinner towards the rear end.

Figures 10, 11, 12, 13, 14, 15, 16, 17:
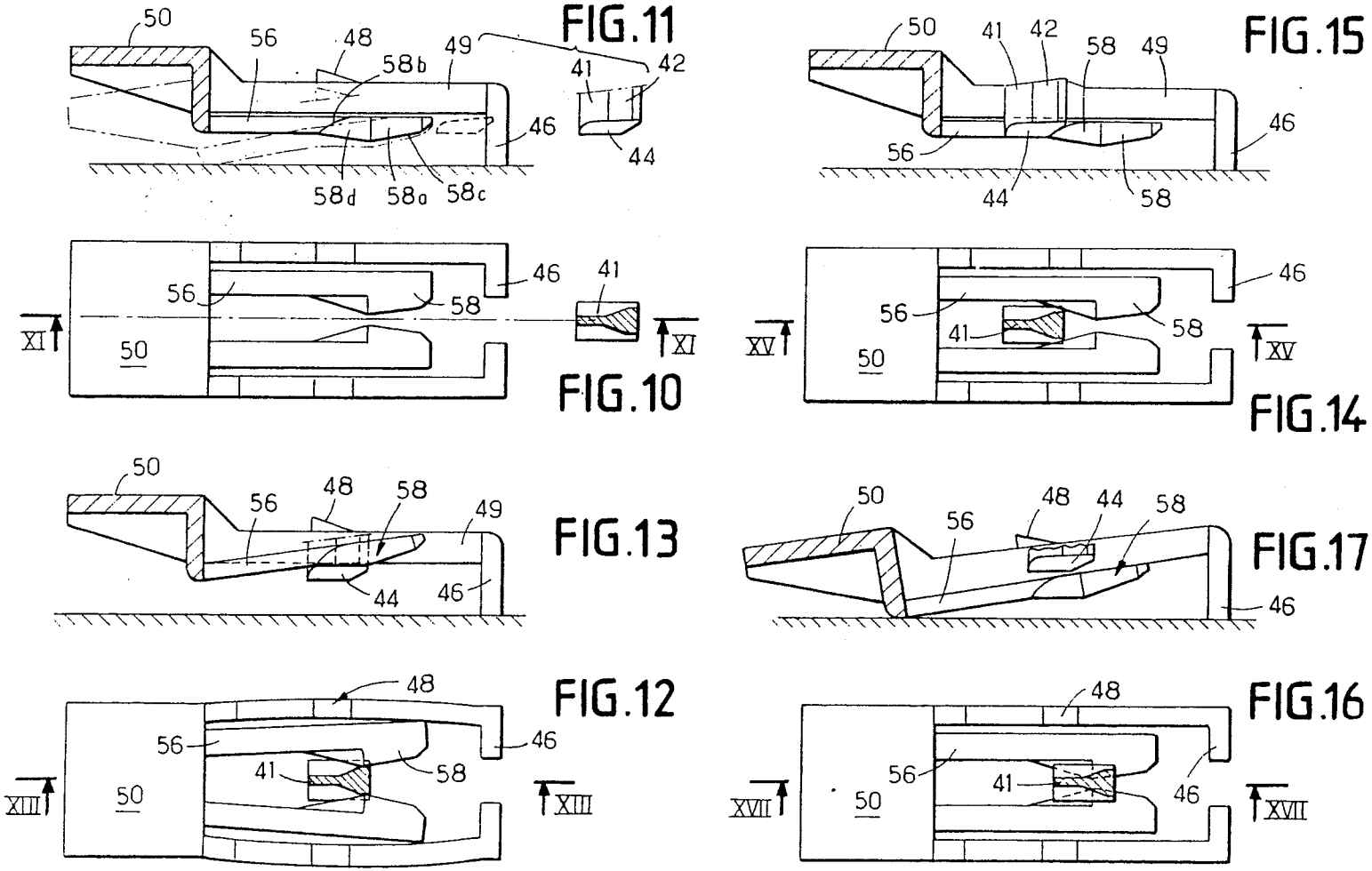
FIG. 10 is a schematic plan view showing one phase of operation.
FIG. 11 is a view in cross-section on the line XI—XI in FIG. 10.
FIG. 12 is a schematic plan view showing another phase of operation.
FIG. 13 is a view in cross-section on the line XIII—XIII in FIG. 12.
FIG. 14 is a schematic plan view showing a further phase of operation.
FIG. 15 is a view in cross-section on the line XV—XV in FIG. 14.
FIG. 16 is a schematic plan view showing a final phase of operation.
FIG. 17 is a view in cross-section on the line XVII—XVII in FIG. 16.

When the male housing member 30 is inserted into the skirt 35 the protuberance 41 is inserted between the projections 57 and 58, and the wedge-shaped part 42 tends to move the tangs 55 and 56 away from each other against the action of the branches 49 against which they abut. Additionally, the inclined parts 44*a* cooperate with the thinner parts 57*c* and 58*c* so that the tangs 55 and 56 are simultaneously raised. If the male housing member 30 is not inserted into the skirt 35 by a length sufficient to make the electrical connection between the male and female contact members the housing members are pushed apart (FIGS. 10 and 13).

When the flat front 43 reaches the edges 57*e*, 58*e*, the ramps 57*d* and 58*d* tend in conjunction with the resilient action of the branches 49 to facilitate further insertion of the male housing member 30 into the skirt 35 at the same time as said branches 49 tilt downwardly to enable the lugs 48 to enter the holes 52 in the wall 35*b* (FIGS. 14 and 15), and to lock together the housings 30 and 36. In the locked position, the flat front 43 is located at the end of the inclined parts 57*d* and 58*d* joined to the tangs 55–56.

When the housing members 30 and 36 are to be decoupled, it is sufficient to tilt the operating member 50 downwards to disengage the lugs 48 from the holes 52 and align the inclined ramps 57*b* and 58*b* with the posterior part 44*b* of the flange 44 (FIGS. 16 and 17) and then to pull apart the housing members, with the flange 44 passing over the projections 57 and 58 by virtue of resilient bending of the tangs 55 and 56. Furthermore, in passing over the projections 57 and 58, the flange 44 does not cause the tangs 55 and 56 to move apart, which means that housing members 30 and 36 can be separated without applying a high force.

Of course, the invention is not limited to the embodiments that have just been described and shown. Numerous modifications of detail may be made thereto without departing from the scope of the invention.

There is claimed:

1. An electrical connector housing comprising a male housing member and a corresponding female housing member; a skirt on said female housing member adapted to receive an anterior end of said male housing member; channels in said male housing member and channels in said female housing member adapted to receive respective electrical contact members; and means for locking said male and female housing members together when said anterior end of said male housing member is inserted into said skirt, said means for locking comprising a resilient bar having a fixed end and a free end, said fixed end having two feet joined to said male housing member near said anterior end, an operating member at said free end of said resilient bar and first locking members, said skirt comprising second locking members adapted to cooperate with said first locking members and a protuberance on its inside surface, said resilient bar further comprising a projection adapted to cooperate with said protuberance and having a first ramp inclined so that insertion of said male housing member into said skirt requires an additional force to allow said first ramp to pass by virtue of resilient deformation of said resilient bar, a second ramp and edge between said first and second ramps so that when said protuberance has passed over said edge during insertion of said male housing member into said skirt said second ramp tends to facilitate further insertion of said male housing member into said skirt, and wherein said protuberance comprises two lugs on the inside wall of said skirt and profiled flanges on said lugs; said resilient bar comprises two projections on respective opposite sides each adapted to cooperate with a corresponding flange; a respective resilient tang forward of each projection extending said first ramp; notches to the rear of said projections adapted to accommodate said profiled flanges, and said resilient tangs have a height such that on inserting said male housing member into said skirt said flanges abut against said resilient tangs.

2. The electrical connector housing according to claim 1, wherein each profiled flange has a flat front at the end towards the open end of said skirt, a flat heel at the other end, and an upper edge that is inclined adjacent said flat front.

3. An electrical connector housing comprising a male housing member and a corresponding female housing member; a skirt on said female housing member adapted to receive an anterior end of said male housing member; channels in said male housing member and channels in said female housing member adapted to receive respective electrical contact members; and means for locking said male and female housing members together when said anterior end of said male housing member is inserted into said skirt, said means for locking comprising a resilient bar having a fixed end and a free end, said fixed end having two feet joined to said male housing member near said anterior end, an operating member at said free end of said resilient bar and first locking members, said skirt comprising second locking members adapted to cooperate with said first locking members and a protuberance on its inside surface, said resilient bar further comprising a projection adapted to cooperate with said protuberance and having a first ramp inclined so that insertion of said male housing member into said skirt requires an additional force to allow said first ramp to pass by virtue of resilient deformation of said resilient bar, a second ramp and an edge between said first and second ramps so that when said protuberance has passed over said edge during insertion of said male housing member into said skirt said second ramp tends to facilitate further insertion of said male housing member into said skirt, and wherein said resilient bar includes a tab to limit its downward movement when inserting said male housing member into said skirt.

4. The electrical connector housing according to claim 3, wherein the free end of said protuberance is joined to a profiled flange which has at its anterior end an edge inclined from its upper surface towards its lower surface and at its posterior end an edge inclined from its lower surface towards it upper surface, said projections having a lower surface that becomes progressively narrower in the direction towards the free end and an upper surface which gets progressively narrower from the edge towards said operating member, the position of said projections and of said flange being such that upon insertion of said male housing member into said skirt the inclined edge of said anterior end of said flange abuts against the thinner end of said lower surface of said projections.

5. The electrical connector housing according to claim 3, wherein said skirt comprises housings and the upper edges of said branches of said resilient bar comprises lugs adapted to be inserted into said housings.

6. An electrical connector housing comprising a male housing member and a corresponding female housing member; a skirt on said female housing member adapted to receive an anterior end of said male housing member; channels in said male housing member and channels in said female housing member adapted to receive respective electrical contact members; and means for locking said male and female housing members together when said anterior end of said male housing member is inserted into said skirt, said means for locking comprising a resilient bar having a fixed end and a free end, said fixed end having two feet joined to said male housing member near said anterior end, an operating member at said free end of said resilient bar and first locking members, said skirt comprising second locking members adapted to cooperate with said first locking members and a protuberance on its inside surface, said resilient bar further comprising a projection adapted to cooperate with said protuberance and having a first ramp inclined so that insertion of said male housing member into said skirt requires an additional force to allow said first ramp to pass by virtue of resilient deformation of said resilient bar, a second ramp and an edge between said first and second ramps so that when said protuberance has passed over said edge during insertion of said male housing member into said skirt said second ramp tends to facilitate further insertion of said male housing ember into said skirt, and wherein said resilient bar is divided into two branches and further comprises between said two branches tow resilient tangs of which one end is joined to the operating member while the free end is provided with said projection, said projection on one of said resilient tangs facing towards said projection on the other tang, each projection comprising a first ramp, an edge and a second ramp, said ramps facing each other and the first ramps of said two resilient tangs forming a convergent entry while said protuberance is formed by a lug extended towards the rear by a wedge-shaped part ending in a flat front.

7. An electrical connector housing assembly comprising a male housing member and a corresponding female housing member, said male housing member including a series of passages that are capable of receiving electrical contact members;

said female housing member including a skirt portion adapted to receive an anterior end of said male housing member, and having a series of passages corresponding to those in said male housing member that are capable of receiving corresponding electrical contact members;

means for locking said male housing member and female housing member together when said anterior end of said male housing member is inserted into said skirt portion of said female housing member; said means for locking including means for pushing apart said male housing member and said female housing member until a sufficient force is exerted, means for facilitating further insertion of said male housing member into said female housing member upon exertion of said sufficient force, and means forming a threshold element which forms a transition zone between said means for pushing apart and said means for facilitating further insertion;

said means for pushing apart, said means for facilitating further insertion, and said means forming a threshold element are positioned on a resilient bar; and said resilient bar includes a fixed end that is joined to said male housing member near said anterior end, and a free end;

said means for locking includes protuberance means positioned on said female housing member;

said means for pushing apart comprises a first ramp means that is inclined so that insertion of said male housing member into said skirt portion requires an additional force to allow said first ramp means to pass said protuberance means by virtue of resilient deformation of said resilient bar; said means for facilitating further insertion comprises a second ramp means inclined so that passage of said second ramp means past said protuberance means is facilitated; and said means forming a threshold element comprises an edge between said first ramp means and second ramp means;

said protuberance means comprise two lugs on the inside wall of said skirt portion, and a flange on each of said two lugs; and said resilient bar comprises two sets of said first ramp means, said second ramp means and said edge positioned on respective opposite sides, with each of said two sets being adapted to cooperate with a flange; and further comprising a resilient tang forward of and extending from each said first ramp means, and notches to the rear of each of said second ramp means, with each notch being adapted to accommodate a corresponding flange; and the height of each said resilient tang being such that upon inserting said male housing member into said skirt portion each flange abuts against a corresponding resilient tang.

8. The electrical connector assembly according to claim 7, wherein each said flange includes a flat front end; and an upper edge that is downwardly inclined to a rearward, flat heel.

9. The electrical connector assembly according to claim 8, wherein said resilient bar includes a tab to limit downward movement when said male housing member is being inserted into said female housing member.

10. The electrical connector assembly according to claim 9, wherein said resilient bar is movable in an upward direction to permit each said rearward, flat heel to be positioned below a corresponding notch, whereby said male housing member and said female housing member may be pulled apart with each said flange sliding below a corresponding resilient tang.

11. The electrical connector assembly according to claim 9, wherein said resilient bar includes two feet for fixing said fixed end to said male housing member.

12. The electrical connector assembly according to claim 9, further including means for polarizing.

13. An electrical connector housing assembly comprising a male housing member and a corresponding female housing member, said male housing member including a series of passages that are capable of receiving electrical contact members;

said female housing member including a skirt portion adapted to receive an anterior end of said male housing member, and having a series of passages corresponding to those in said male housing member that are capable of receiving corresponding electrical contact members;

means for locking said male housing member and female housing member together when said anterior end of said male housing member is inserted into said skirt portion of said female housing member; said means for locking including means for pushing apart said male housing member and said female housing member until a sufficient force is exerted, means for facilitating further insertion of said male housing member into said female housing member upon exertion of said sufficient force, and means forming a threshold element which forms a transition zone between said means for pushing apart and said means for facilitating further insertion;

said means for pushing apart, said means for facilitating further insertion, and said means forming a threshold element are positioned on a resilient bar; and said resilient bar includes a fixed end that is joined to said male housing member near said anterior end, and a free end; and wherein said means for locking includes protuberance means and means forming apertures located on said female housing member; and projections mounted on said resilient bar that fit into said means forming apertures when said male housing member and said female housing member are assembled.

14. The electrical connector assembly according to claim 13, wherein said resilient bar is divided into two branches and further comprising two resilient tangs between said two branches.

15. The electrical connector assembly according to claim 14, wherein said means for pushing apart comprises a first ramp means that has an inclined edge so that insertion of said male housing member into said skirt portion requires an additional force to allow said first ramp means to pass said protuberance means by virtue of resilient deformation of said resilient tangs; said means for facilitating further insertion comprises a second ramp means having an inclined edge portion so that passage of said second ramp means past said protuberance means is facilitated; and said means forming a threshold element comprises an edge between said first ramp means and said second ramp means.

16. The electrical connector assembly according to claim 15, wherein each of said two resilient tangs includes a rearward end that is attached to said resilient bar, and a forward, free end.

17. The electrical connector assembly according to claim 16, wherein said resilient bar includes two sets of said first ramp means, said second ramp means and said edge, and each of said two sets being positioned substantially adjacent to said forward, free end of each of said resilient tangs.

18. The electrical connector assembly according to claims 17, wherein said first ramp means and said second ramp means in each of said two sets are positioned on said two resilient tangs to face each other, with each said edge being positioned adjacent each other thereby forming a convergent entry.

19. The electrical connector assembly according to claim 18, wherein said protuberance means comprises a lug having a wedge-shaped part which extends rearwardly into said female housing member, and ends in a flat front.

20. The electrical connector assembly according to claim 19, wherein, for each resilient tang, said first ramp means include a lower surface that becomes progressively thicker in a direction towards said edge, and said second ramp means include a lower surface that becomes progressively thinner in a direction away from said edge and towards said fixed end of said resilient tang.

21. The electrical connector assembly according to claim 20, wherein said lug includes an anterior end having an edge that is rearwardly and upwardly inclined from a lower surface to an upper surface, whereby when said male housing member is inserted into said female housing member, said inclined, anterior end abuts against the lower surface of said first ramp means.

22. The electrical connector assembly according to claim 21, wherein, for each resilient tang, said first ramp means include an upper surface that becomes progressively thicker in a direction towards said edge, and said second ramp means include an upper surface that becomes progressively thinner in a direction away from said edge and towards said fixed end of said resilient tang; and said lug includes a posterior end having an edge that is rearwardly and upwardly inclined from a lower surface to an upper surface, whereby when said resilient bar is pushed in a downward direction, said projections are disengaged from said means forming apertures, and said inclined, posterior end contacts said upper surface of said second ramp means so that the male housing member and female housing member may be disassembled.

23. The electrical connector assembly according to claim 22, wherein said resilient bar includes two feet for fixing said fixed end to said male housing member.

24. The electrical connector assembly according to claim 22, further including means for polarizing.

25. A male housing member comprising a housing member including a series of passages that are capable of receiving electrical contact members;

a resilient bar having a fixed end that is joined to said housing member, and a free end;

said resilient bar including first ramp means having a rearwardly and upwardly inclined upper surface, a second ramp means having a rearwardly and downwardly inclined upper surface, with said first ramp means and said second ramp means being connected by an edge; and said resilient bar includes two sets of said fist ramp means, said second ramp means and said edge mounted on opposite sides of said resilient bar.

26. The male housing member according to claim 25, further comprising a resilient tang forward of and extending from each said first ramp means; and a notch to the rear of each of said second ramp means.

27. The male housing member according to claim 26, wherein said resilient bar includes two feet for fixing said fixed end to said housing member.

28. The male housing member according to claim 26, further including means for polarizing.

29. A male housing member comprising a housing member including a series of passages that are capable of receiving electrical contact members;

a resilient bar having a fixed end that is joined to said housing member, and a free end; said resilient bar being divided into two branches and comprising between said two branches two resilient tangs, with each of said two resilient tangs having a rearward end that is attached to said resilient bar, and a forward, free end;

each of said two resilient tangs including, substantially adjacent to said forward, free end, a first ramp means, a second ramp means, and an edge connecting said first ramp means and said second ramp means;

and said resilient bar including projections on an upper surface; and said first ramp means is located closer to the free end of said resilient tang than said second ramp means; said first ramp means and said second ramp means are positioned on said two resilient tangs to face each other; and said connecting edges are positioned adjacent each other.

30. The male housing member according to claim 29, wherein said first ramp mean and said second ramp means include inclined surface portions, with the first ramp means being upwardly inclined toward said connecting edge, and said second ramp means being downwardly inclined away from said edge.

31. The male housing member according to claim 30, wherein, for each resilient tang, said first ramp means include a lower surface that becomes progressively thicker in a direction towards said edge, and said second ramp means include a lower surface that becomes progressively thinner in a direction away from said edge and towards said fixed end of said resilient tang.

32. The male housing member according to claim 31, wherein, for each resilient tang, said first ramp means include an upper surface that becomes progressively thicker in a direction towards said edge, and said second ramp means include an upper surface that becomes progressively thinner in a direction away from said edge and towards said fixed end of said resilient tang.

33. The male housing member according to claim 32, wherein said resilient bar includes two feet for fixing said fixed end to said housing member.

34. The male housing member according to claim 32, further including means for polarizing.

35. A female housing member comprising a housing member including a skirt portion adapted to receive an anterior end of a male housing member, said housing member including a series of passages adapted to correspond to a series of passages in the male housing member;

two lugs on the inside wall of said skirt portion, and a flange on each of said two lugs; and each said flange includes a flat front end, and an upper edge that is downwardly inclined to a rearward, flat heel.

36. The female housing member according to claim 35, further including means for polarizing.

* * * * *